US009128430B2

(12) United States Patent
Kawakami et al.

(10) Patent No.: US 9,128,430 B2
(45) Date of Patent: Sep. 8, 2015

(54) IMAGE FORMING APPARATUS USING POWER CONTROL TO SELECT POWER LEVELS BASED ON TEMPERATURE

(71) Applicant: CANON KABUSHIKI KAISHA, Tokyo (JP)

(72) Inventors: Rikuo Kawakami, Numazu (JP); Yasuhiro Shimura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 75 days.

(21) Appl. No.: 13/862,855

(22) Filed: Apr. 15, 2013

(65) Prior Publication Data

US 2013/0272738 A1 Oct. 17, 2013

(30) Foreign Application Priority Data

Apr. 17, 2012 (JP) ..... 2012-094055

(51) Int. Cl.
*G03G 15/20* (2006.01)
*G03G 15/00* (2006.01)

(52) U.S. Cl.
CPC ..... *G03G 15/205* (2013.01); *G03G 15/2039* (2013.01); *G03G 15/80* (2013.01); *G03G 2215/2035* (2013.01)

(58) Field of Classification Search
CPC ..... G03G 15/2078; G03G 15/2039; G03G 15/80; G03G 15/205
USPC ..... 399/45, 88, 69, 67
See application file for complete search history.

(56) References Cited

U.S. PATENT DOCUMENTS

2006/0051118 A1* 3/2006 Kaji et al. ..... 399/69

FOREIGN PATENT DOCUMENTS

JP 2011-018027 A1 1/2011

* cited by examiner

*Primary Examiner* — David Gray
*Assistant Examiner* — Andrew V Do
(74) *Attorney, Agent, or Firm* — Canon USA, Inc. IP Division

(57) ABSTRACT

One disclosed aspect of the embodiments relates to power control of a heater in a fixing unit. A plurality of control tables having different ratios of phase control waveforms and wave number control waveforms in one control cycle have been set, and a control table is selected depending on a set target temperature.

17 Claims, 12 Drawing Sheets

<AT LOW TEMPERATURE>

<AT HIGH TEMPERATURE>

<AT HIGH TEMPERATURE>

<AT LOW TEMPERATURE>

IMAGE FORMING APPARATUS USING POWER CONTROL TO SELECT POWER LEVELS BASED ON TEMPERATURE

BACKGROUND OF THE INVENTION

1. Field of the Invention

One disclosed aspect of the embodiments relates to an image forming apparatus having a fixing unit for heat fixing an unfixed toner image formed on a recording sheet onto the recording sheet.

2. Description of the Related Art

Image forming apparatuses such as copying machines and laser beam printers are provided with fixing units. Such fixing units can be classified into several types, for example, a heat roller type fixing unit having a halogen heater as a heat source, and a film heating fixing unit having a ceramic heater as a heat source.

The heater provided in the fixing unit is connected to a commercial alternating-current (AC) power supply via a switching element such as a triac. From the commercial AC power supply, electric power is supplied to the heater. The fixing unit is provided with a temperature detection element for detecting temperature in the fixing unit, for example, a thermistor. A central processing unit (CPU) performs on/off control of the switching element such that a temperature detected with the temperature detection element is kept to a target temperature. Such power control keeps the temperature of the fixing unit to the target temperature. The on/off control to the heater is performed in phase control or wave number control.

In the phase control, the electric power to be supplied to the heater is controlled by turning on the switching element at an arbitrary phase angle within half-cycle of an AC waveform. In the wave number control, the electric power to be supplied to the heater is controlled by turning on the switching element in units of half-cycle of the AC waveform.

The phase control is employed to suppress flickering of a lighting apparatus, the phenomenon is called flicker. The flicker refers to the flickering of the lighting apparatus that occurs when the AC power supply produces voltage fluctuations due to load current fluctuations of an electrical apparatus connected to the same power supply as the lighting apparatus and an impedance of a distribution line. In the phase control, the electric current flows at each half-cycle, and the amount of change and the period of change of the current are small, which suppresses the occurrence of the flicker. Meanwhile, in the wave number control, the switching element is turned on and off in half-cycle units of the commercial AC power supply, and this generates more current fluctuations than those in the phase control. Consequently, in the wave number control, the flicker is more likely to occur.

The wave number control is employed to reduce harmonic current and switching noise. The harmonic current and switching noise are produced due to rapid current change in the turning on/off operation of the heater. In the wave number control, the on/off operation of the heater is always performed at zero-cross points, and consequently, the harmonic current and switching noise are less likely to occur as compared to the phase control in which the switching operation is performed in the middle of the half-cycles of the AC waveforms. The harmonic current and switching noise tend to occur to a larger extent with a higher voltage of the AC power supply being used.

In view of the above, it is general to fix a power control method depending on the commercial AC power supply voltage in the region the image forming apparatus is used. For example, apparatuses designed for the regions of the commercial AC power supply voltage of 100 to 120 V employ the phase control method which is advantageous to the flicker, and apparatuses designed for the regions of the commercial AC power supply voltage of 220 to 240 V employ the wave number control method which is advantageous to the harmonic current and switching noise.

In addition to the control methods, methods of combining the phase control and the wave number control are discussed. For example, Japanese Patent Application Laid-Open No. 2011-18027 discusses a method in which a part of half-cycles in one control cycle consisting of a plurality of half-cycles is controlled in the phase control, and the rest of the half-cycles are controlled in the wave number control. According to the method, as compared to the case the power supply is performed only in the phase control, the occurrence of the harmonic current and switching noise can be suppressed. Further, the method enables reduction of the flicker as compared to the case the power supply is performed only in the wave number control, and the power control to the heater can be controlled by further multilevel control.

In the description, a positive half-cycle for supplying electric power in the phase control or the wave number control is defined as a positive energization cycle, and similarly a negative half-cycle for supplying electric power is defined as a negative energization cycle. Further, a half-cycle that is not supplying electric power is defined as a non-energization cycle. One unit period for controlling the amount of power to be supplied to the heater by dividing the period into certain periods is defined as one control cycle. In the description below, as an example, a method of updating power supply to a heater and an upper limit current value in one control cycle consisting of four full-cycles (eight half-cycles) is described.

To perform power control of a fixing unit, a sequence controller compares a temperature detected with a temperature detection element to a preliminary set target temperature, and calculates a power ratio (power level) to be supplied to the heater. Then, the sequence controller determines a phase angle or a wave number corresponding to the power ratio, and under the phase condition or the wave number condition, a switching element for driving the heater is turned on or off.

There is a general tendency that the unevenness of heat generation in one control cycle can be reduced by increasing the number of times of phase control in the one control cycle. The reduction of the unevenness of heat generation of the heater for balancing the heat quantity to be applied to the recording sheet enables increase in the print quality and fixability. As described above, the wave number control is advantageous to the harmonics. Consequently, in actual control operation, it is desirable to employ a control pattern in which the number of times of the wave number control is increased as much as possible in a range satisfying the harmonic specifications.

Meanwhile, some heaters have characteristics that a resistance value varies with change in temperature. The degree of change is represented by a temperature coefficient of resistance. If the resistance value increases in proportion to temperature increase, then, the temperature coefficient is referred to as a positive temperature coefficient (PTC) (positive temperature characteristics of resistance), and if the resistance value decreases in inverse proportion to temperature increase, then, the temperature coefficient is referred to as a negative temperature coefficient (NTC) (negative temperature characteristics of resistance).

Influence of the temperature coefficients of resistance of the heater will be described. Image forming apparatuses are provided with various print modes to handle various types of paper to be used, differences in usage environments, and the like. Depending on the type of paper and the usage environment, optimal fixing conditions vary, and consequently, the target temperature is changed under the individual conditions. To change the target temperature means to change the heat generation temperature of the heater, and if the temperature is changed, due to the influence of the temperature coefficients of resistance, the resistance value of the heater fluctuates. As a result, the electric current flowing through the heater also fluctuates. As described above, there is a close connection between the heater current and the harmonics, and the current fluctuations affect the harmonic level.

First, a PTC heater having positive resistance temperature characteristic is described. The heater resistance value increases in proportion to temperature increase. In a state the target temperature is set to a high temperature is used as a reference, within a range the harmonic specifications can be satisfied, if generation of a control pattern in which the number of times of the phase control in one control cycle is increased as much as possible is performed, when the target temperature is lowered, due to the increasing heater current, the harmonic specifications are not satisfied. On the other hand, in a state the target temperature is low is used as a reference, if generation of a control pattern in which the number of times of the phase control is small is performed, when the target temperature is increased, the harmonic specifications are satisfied. However, the heat generation unevenness of the heater is large, and this is disadvantageous to image quality of print image.

Next, an NTC heater having negative resistance temperature characteristic is described. The heater resistance value decreases in inverse proportion to temperature increase. In a state the target temperature is low is used as a reference, within a range the harmonic specifications are satisfied, if generation of a control pattern in which the number of times of the phase control in one control cycle is increased as much as possible is performed, when the target temperature is increased, due to the increase in the heater current, the harmonic specifications are not satisfied. On the other hand, in a state the target temperature is high is used as a reference, if generation of a control pattern in which the number of times of the phase control is small is performed, when the target temperature is lowered, the harmonic specifications are satisfied. However, the heat generation unevenness of the heater is large, and this is disadvantageous to image quality of print image.

SUMMARY OF THE INVENTION

One disclosed aspect of the embodiments is directed to providing an image forming apparatus capable of maintaining the image quality while suppressing the deterioration in the harmonic level due to the temperature coefficients of resistance.

According to an aspect of the embodiments, an image forming apparatus including a fixing unit configured to perform heat fixing an unfixed toner image formed on a recording sheet onto the recording sheet, the fixing unit includes a heater that generates heat by electric power supplied from an alternating-current power supply; and a power control unit configured to control the electric power to be supplied to the heater such that the fixing unit is kept to a target temperature, wherein the power control unit is configured to select a power level per one control cycle from a control table in which a plurality of power levels have been set in accordance with a temperature of the fixing unit, the duration of the one control cycle being defined by a predetermined number of consecutive half-cycles in an alternating-current waveform, wherein the alternating-current waveforms flowing in the heater in the one control cycle including a phase control waveform and a wave number control waveform, wherein as the control table, a plurality of control tables having different ratios of the phase control waveforms and the wave number control waveforms in the one control cycle have been set, and the control unit is configured to select one of the plurality of control tables depending on a set target temperature, and select a power level from the selected control table in accordance with the temperature of the fixing unit.

According to another aspect of the embodiments, a method of controlling a heater is provided. The method includes selecting a control table depending on a target temperature of the fixing unit from a plurality of control tables having different ratios of phase control waveforms and wave number control waveforms in one control cycle, selecting a power level corresponding to a temperature of the fixing unit from the selected control table, and supplying electric power to the heater at the selected power level.

Further features and aspects of the disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles of the disclosure.

DESCRIPTION OF THE EMBODIMENTS

Various exemplary embodiments, features, and aspects of the disclosure will be described in detail below with reference to the drawings. One disclosed feature of the embodiments may be described as a process which is usually depicted as a flowchart, a flow diagram, a structure diagram, or a block diagram. Although a flowchart may describe the operations as a sequential process, many of the operations may be performed in parallel or concurrently. In addition, the order of the operations may be re-arranged. A process is terminated when its operations are completed. A process may correspond to a method, a program, a procedure, a method of manufacturing or fabrication, etc. One embodiment may be described by a schematic drawing depicting a physical structure. It is understood that the schematic drawing illustrates the basic concept and may not be scaled or depict the structure in exact proportions.

The first exemplary embodiment will be described.

Figure 11:
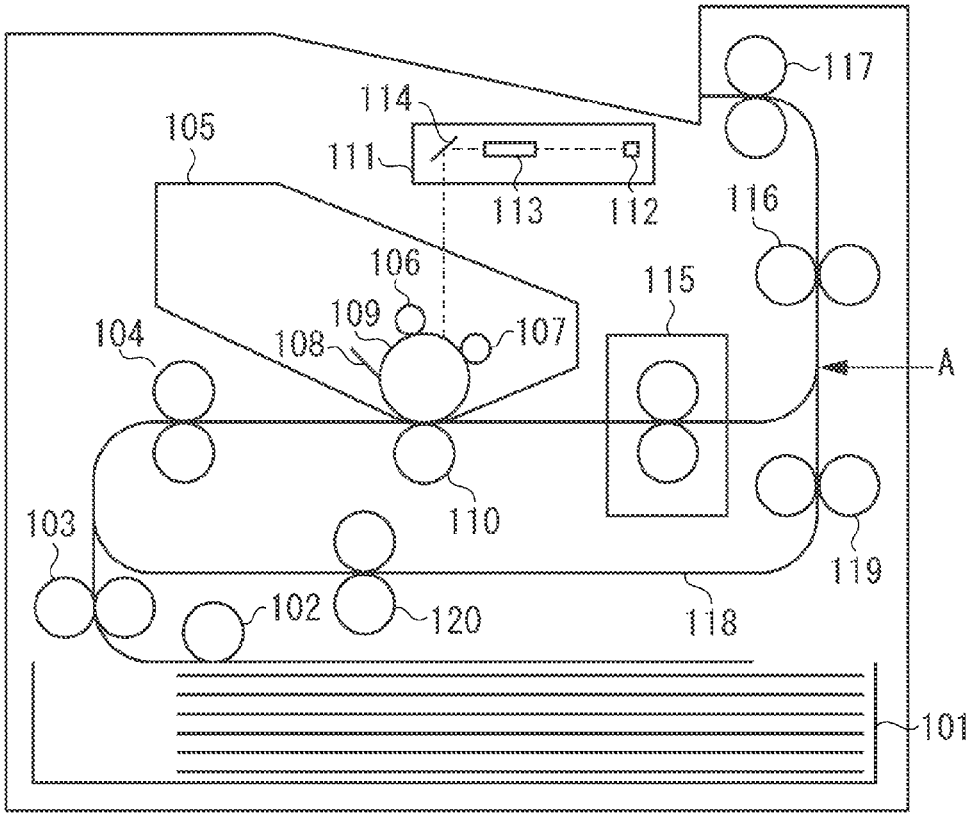
FIG. 11 illustrates a configuration of a printer.

FIG. 11 illustrates a structure of an electrophotographic method image forming apparatus. From recording sheets stacked in a sheet feed cassette 101, only one sheet is sent from the sheet feed cassette with a pickup roller 102, and conveyed toward registration rollers 104 with sheet feeding rollers 103. The recording sheet is further conveyed to a toner image transfer portion with the registration rollers 104 at a predetermined timing. A process cartridge 105 includes a charging unit 106, a development unit 107, a cleaning unit 108, and an electrophotographic photosensitive member 109, which are integrated as a unit. A toner image formed on the photosensitive member 109 is transferred onto the recording sheet at a transfer portion between a transfer roller 110 and the photosensitive member 109. A laser diode 112 emits light corresponding to the image information. A polygonal mirror 113 scans with the laser beam. A mirror 114 guides the laser beam for scan onto the photosensitive member 109. The image formation process is publicly known, and therefore, detailed description of the process is omitted.

The recording sheet on which the toner image is transferred is conveyed to a fixing unit 115 and fixing processing is performed onto the sheet. The recording sheet is further conveyed with intermediate discharge rollers 116, and discharge rollers 117 to the outside of the image forming apparatus main body, and the series of printing operation is completed.

Figure 2:
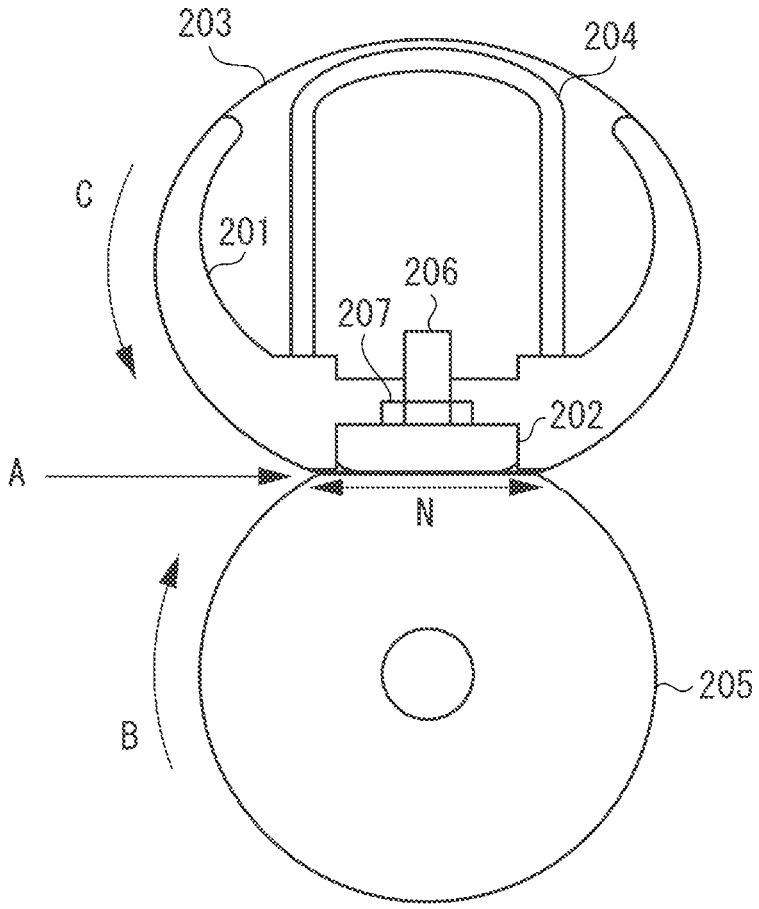
FIG. 2 illustrates a structure of a film-type fixing apparatus (fixing unit).

FIG. 2 illustrates a schematic configuration of the fixing unit 115. The fixing unit 115 is a film-heat type device having a ceramic heater that serves as a heat source. A heater holder 201 made of heat resistant resin holds the ceramic heater and guides the rotation of a fixing film 203. A ceramic heater 202 is fit into a groove portion formed along the longitudinal direction of the lower surface of the heater holder 201, and the ceramic heater 202 is a horizontally oriented member in which the direction crossing the recording sheet conveyance path is the longitudinal direction. A heat resistance film member (hereinafter, referred to as fixing film) 203 of an endless belt shape is loosely externally fit to the heater holder 201 on which the ceramic heater 202 is attached. A stay 204 is a metallic rigid member in which the vertical direction with respect to the drawing is the longitudinal direction. The stay 204 is arranged inside the heater holder 201. A pressure roller 205 is arranged to be pressure contact with the ceramic heater 202, pinching the fixing film 203. The range indicated by arrow N illustrates a fixing nip portion formed by the pressure contact.

The pressure roller 205 is rotationally driven by a motor (not illustrated) in the arrow B direction at a predetermined speed. The rotation of the pressure roller 205 causes the fixing film 203 to be rotatably driven in the arrow C direction. The recording sheet bearing the unfixed toner image is heated while being pinched and conveyed at the fixing nip portion N. The unfixed toner image is subjected to heat fixing onto the recording sheet. The recording sheet that has passed through the fixing nip portion N is separated from the surface of the fixing film 203 and further conveyed. The arrow A direction in FIG. 2 indicates the conveyance direction of the recording sheet. The fixing unit 115 includes a thermistor 206 for detecting temperature of the ceramic heater 202. The thermistor 206 is pressed against the ceramic heater 202 at a predetermined pressure with a spring or the like to detect temperature of the ceramic heater 202. An excessive temperature rise prevention member 207 is arranged on the ceramic heater 202 as a member for preventing the heater from excessive temperature rise in the event of a breakdown of an electric power control unit for controlling the power supply to the ceramic heater 202 causing thermal runaway. The excessive temperature rise prevention member 207 is, for example, a thermal fuse or a thermal switch. Due to a breakdown of the electric power control unit, if the ceramic heater 202 falls in a thermal runaway state and the temperature of the excessive temperature rise prevention member 207 exceeds a predetermined temperature, the excessive temperature rise prevention member becomes open to shut down the power supply to the ceramic heater 202.

Figure 3:
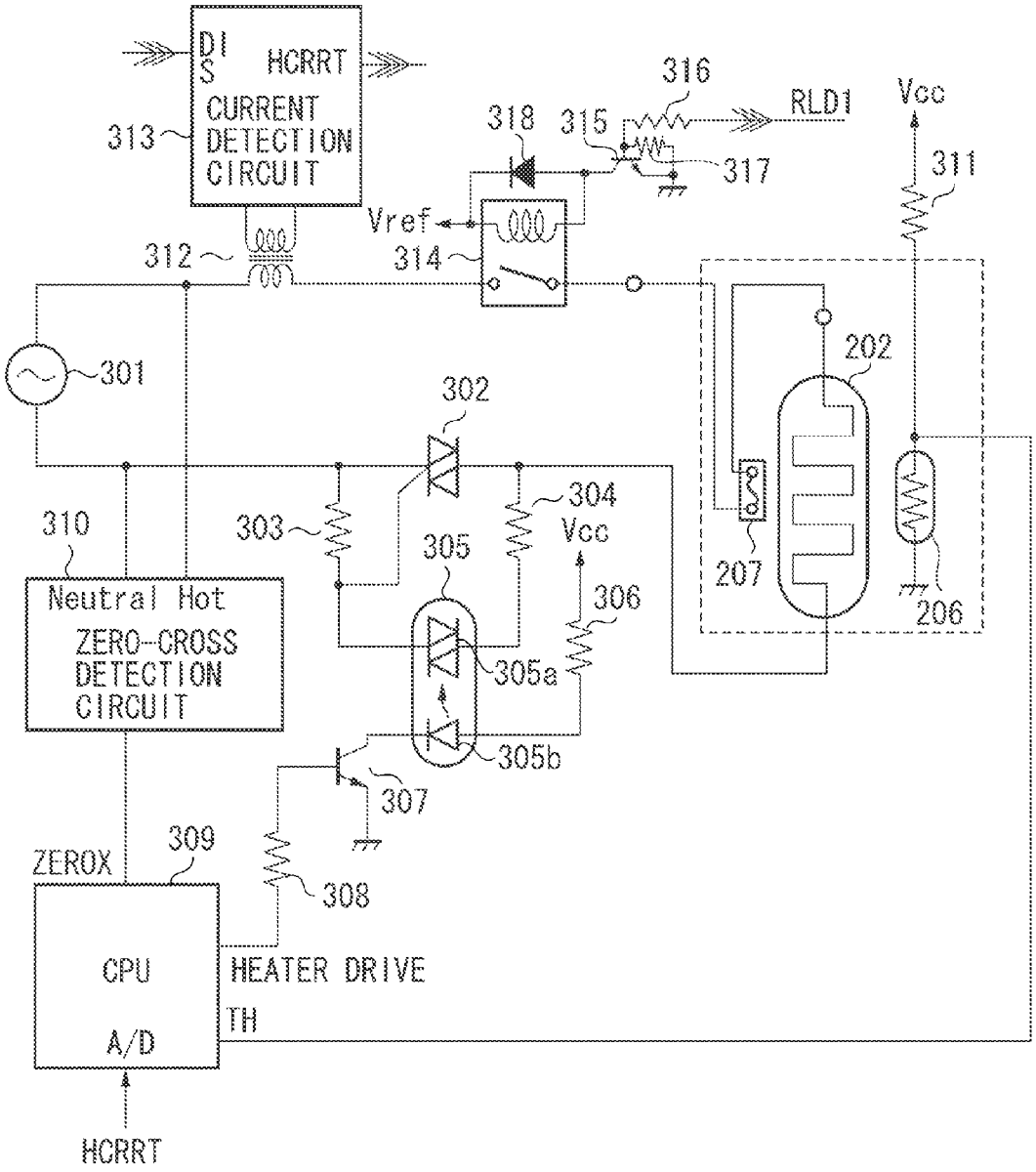
FIG. 3 illustrates a configuration of a heater driving circuit in the fixing unit.

FIG. 3 illustrates a heater drive circuit and a power control circuit (power control unit). In the drawing, a commercial AC power supply 301 is connected with an image forming apparatus. The image forming apparatus supplies the electric power from the commercial AC power supply 301 to the ceramic heater 202 to cause the ceramic heater 202 to generate heat. The power supply to the ceramic heater 202 is performed through energization and shutoff of a triac 302. Resistors 303 and 304 are bias resistors for the triac 302. A photo-triac coupler 305 ensures a creepage distance between the primary part and the secondary part.

The triac 302 is turned on by energizing a light emitting diode 305*b* of the photo-triac coupler 305. A resistor 306 regulates a current passing through the photo-triac coupler 305. A transistor 307 turns on and off the photo-triac coupler 305. The transistor 307 operates according to a heater drive signal from a CPU (power control unit) 309 via a resistor 308. The input power-supply voltage from the commercial AC power supply 301 is also input into a zero-cross detection circuit 310 that serves as a voltage waveform detection unit.

The zero-cross detection circuit 310 detects zero-cross points of the input power-supply voltage, and outputs a zero-cross signal to the CPU 309. A current detection transformer 312 converts the electric current passing through the ceramic heater 202 into a voltage, and inputs the value to a current detection circuit 313. The current detection circuit 313 converts the voltage-converted heater current waveform into an effective value or a square value of the value, performs analog-digital (A/D) conversion to the calculated value, and inputs the converted value to the CPU 309 as an HCRRT signal. The temperature of the heater detected by the thermistor 206 is detected as a divided voltage between a resistor 311 and the thermistor 206, A/D conversion is performed to the values, and the converted value is input to the CPU 309 as a TH signal. The CPU 309 compares the temperature of the ceramic heater 202 with a set temperature (target temperature) set in the CPU 309. The operation enables the CPU 309 to calculate a power ratio (power level) to be supplied to the ceramic heater 202. The CPU 309 further converts the power ratio into a control level of a phase angle (phase control) and a wave number (wave number control) corresponding to the power ratio, and outputs an ON signal (heater drive signal) corresponding to the control level to the transistor 307. In calculating the ratio of the power to be supplied to the ceramic heater 202, based on the HCRRT signal notified of from the current detection circuit 313, the CPU 309 calculates a maximum power ratio, and controls the power such that a power equal to or less than the maximum power ratio is to be supplied.

Figure 4:
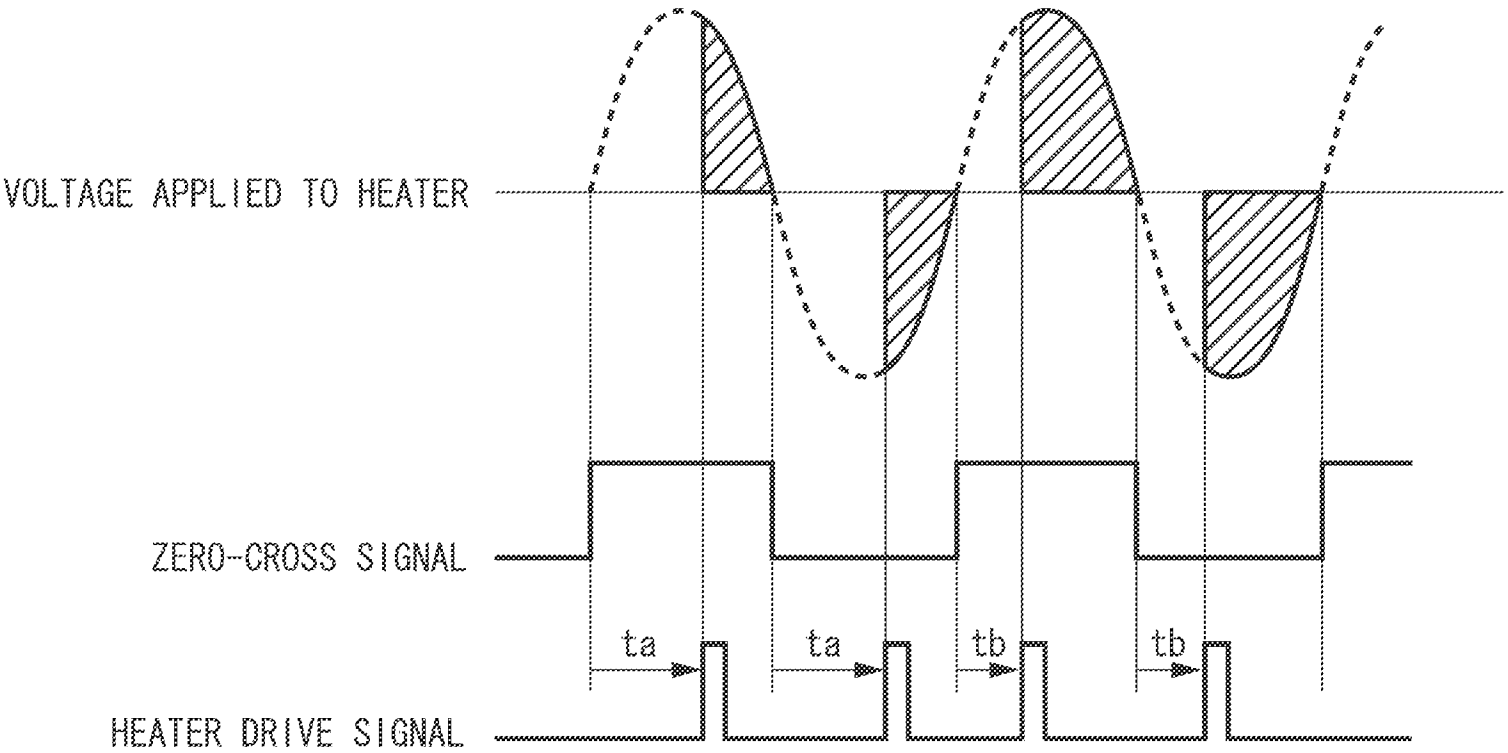
FIG. 4 illustrates an example of the phase control.

The phase control and the wave number control that are power control methods applied to the heater are described. FIG. 4 illustrates an example of the phase control. In the zero-cross signal, the logic is switched at a point the potential is switched from positive to negative, or from negative to positive in the commercial AC power supply, and if the heater drive signal is turned on at a time a time period ta has elapsed since the rising edge or the falling edge, the electric current flows in the heater in the part indicated by the diagonal lines in FIG. 4, and thus the electric power is supplied. After the heater is turned on, at a next zero-cross point, the power supplied to the heater is turned off due to the characteristics of the triac 302. Consequently, by turning-on the heater drive signal again at a time the time period ta elapses from the edge of the zero-cross signal, in the next half-cycle, the same electric power is also to be supplied to the heater.

If the heater drive signal is turned on at a time tb that is different from the time ta has elapsed, the energization time to the heater is changed, and consequently, the power supplied to the heater can be changed. As described above, the power supplied to the heater can be controlled by changing the time for turning on the heater drive signal from the edge of the zero-cross signal for each half-cycle. In the phase control, as illustrated in FIG. 4, in the middle of the half-cycle of the AC power supply waveform, the energization to the heater is turned on. As a result, the electric current flowing in the heater rapidly rises, and a harmonic current flows. The harmonic current largely increases as the amount of the rise of the electric current increases largely. Consequently, at the time the phase angle is 90 degrees, that is, at the time the supplied power is 50%, the harmonic current becomes maximum. The rising edge of the current is generated every half-cycle, and many harmonic currents flow. To solve the problem of the harmonic currents, some measures should be taken. To cope with the problem, in many cases, a circuit component such as a filter is to be provided. Meanwhile, since the electric current smaller than one half-cycle flows each half-cycle, the amount of change in the electric current is small. Further, the cycle of change is short, and consequently, the influence on flicker is small.

Figure 5:
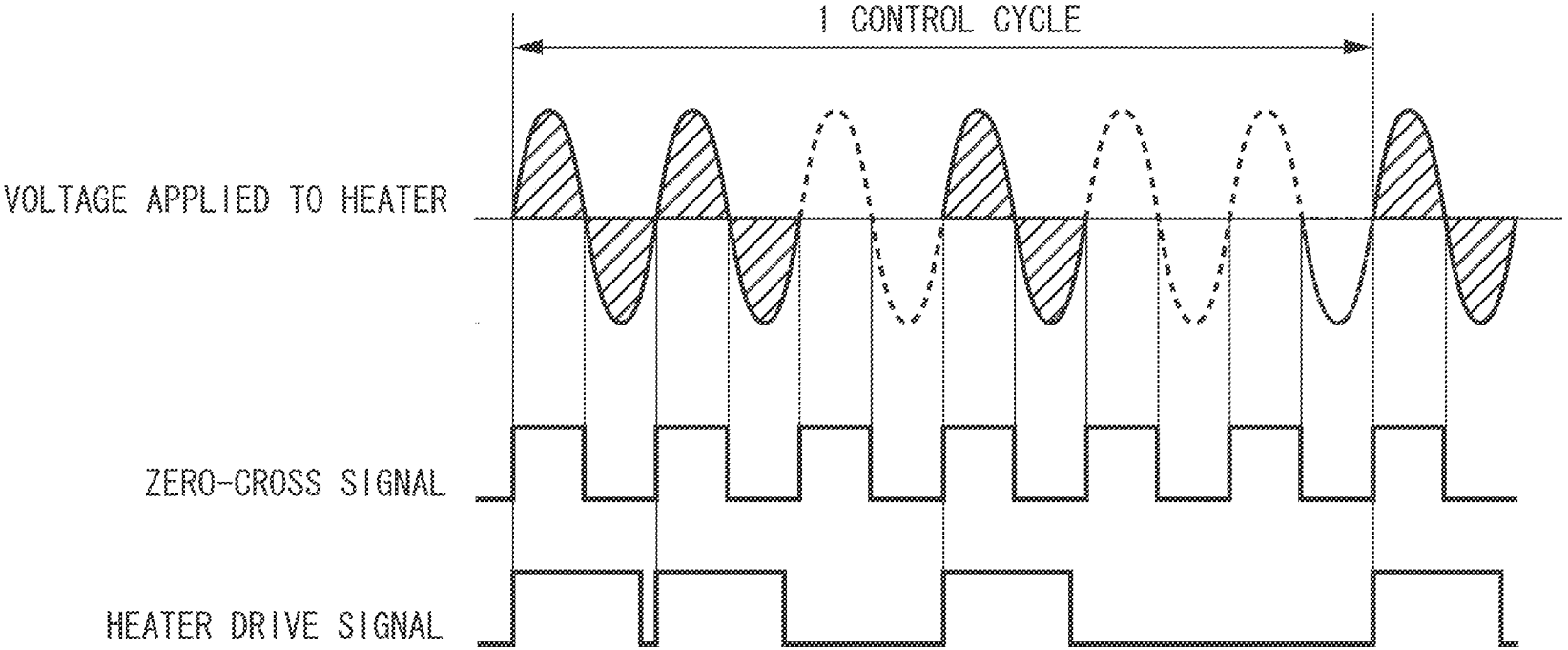
FIG. 5 illustrates an example of the wave number control.

FIG. 5 illustrates an example of the wave number control. In the wave number control, on/off control is performed in units of half-cycle of commercial AC waveform. When the turning-on operation is performed, the heater drive signal is turned on at an edge of the zero-cross signal. For example, twelve half-cycles constitute one control cycle, and the power supplied to the heater is controlled by changing the number of half-cycles to be turned on in the one control cycle. In FIG. 5, out of the twelve half-cycles, six half-cycles are turned on, and consequently, the power supplied to the heater is 50%. It is assumed that when the turning-on operation is performed, consecutive two half-cycles are to be turned on. In the wave number control, the turning on/off operation of the heater is always performed at a zero-cross point, and consequently, the rapid rising edge in the electric current as in the phase control is not generated, and the harmonic current is very small. Meanwhile, since the electric current flows in unit of half-cycle, the amount of change in the electric current is large, and the cycle of change is long, and consequently, the influence on flicker is large. To solve the problem, the positions (control pattern) of the half-cycles to be turned on in one control cycle are controlled such that the influence of the cycle of change of the electric current on the flicker is to be suppressed as much as possible.

In the exemplary embodiment, as in the wave number control, a plurality of half-cycles of the commercial AC waveform constitute one control cycle, and a part of the half-cycles is controlled in the phase control, and the rest of the half-cycles are controlled in the wave number control. In other words, the AC waveforms of the electric current flowing in the heater in one control cycle include the phase control waveforms and the wave number control waveforms. In such a control method, especially, the phase control is not performed on each half-cycle, and as a result, the flowing harmonic current can be suppressed. Further, since the phase control waveforms are contained, even if the one control cycle is short, the electric power can be controlled by multilevel control. Consequently, as compared to the control of only by the wave number control, the control cycle can be shortened, and the cycle of change of the electric current can be shortened. As a result, the reduction of flicker can be performed more easily, and as compared to the control of only by the phase control, the harmonic current can be reduced. As described above, in the CPU (power control unit) 309 according to the exemplary embodiment, consecutive half-cycles of a predetermined number of AC waveform flowing through the heater constitute one control cycle, and in each one control cycle, the electric power to be supplied to the heater is controlled according to a power ratio (power level) corresponding to a temperature of the fixing unit, the ratio selected from a control table in which a plurality of power ratios have been set.

Figure 1A:
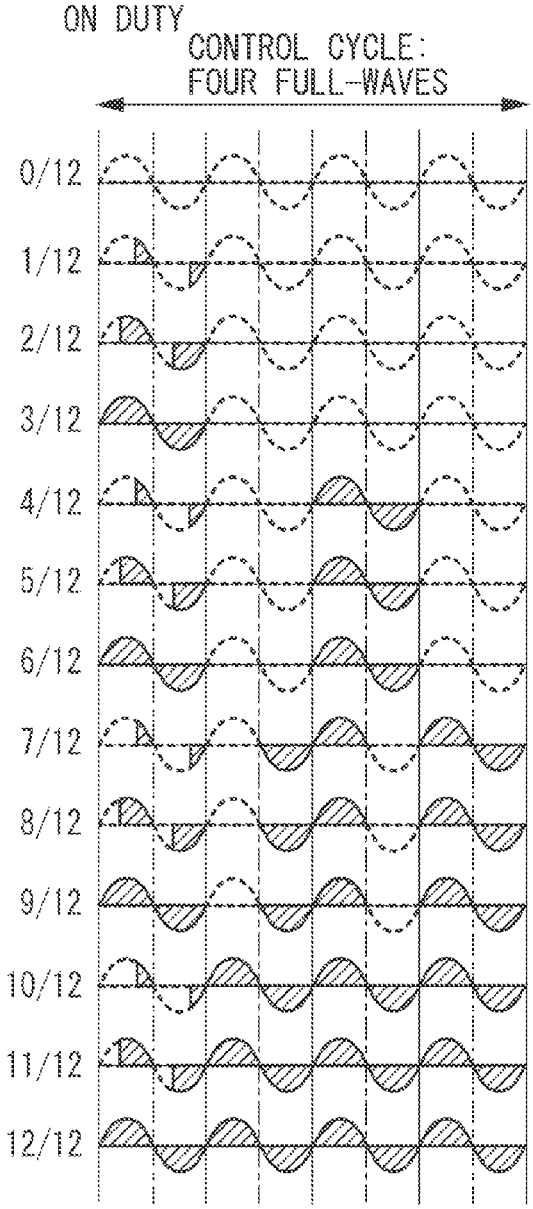
FIGS. 1A and 1B illustrate control tables to be used when a PTC heater is used.
Figure 1B:
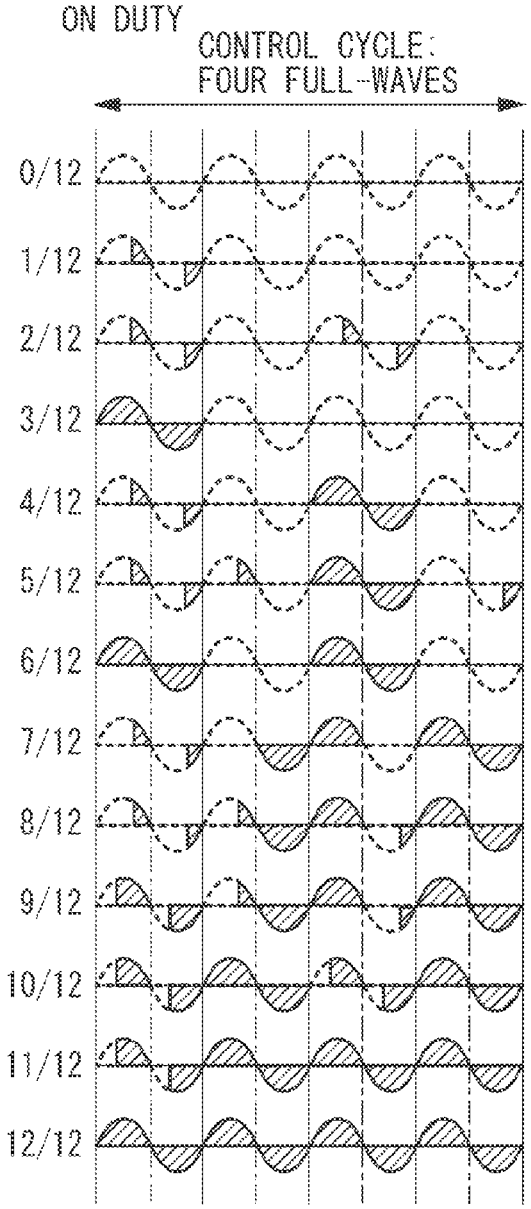
Figure 12:
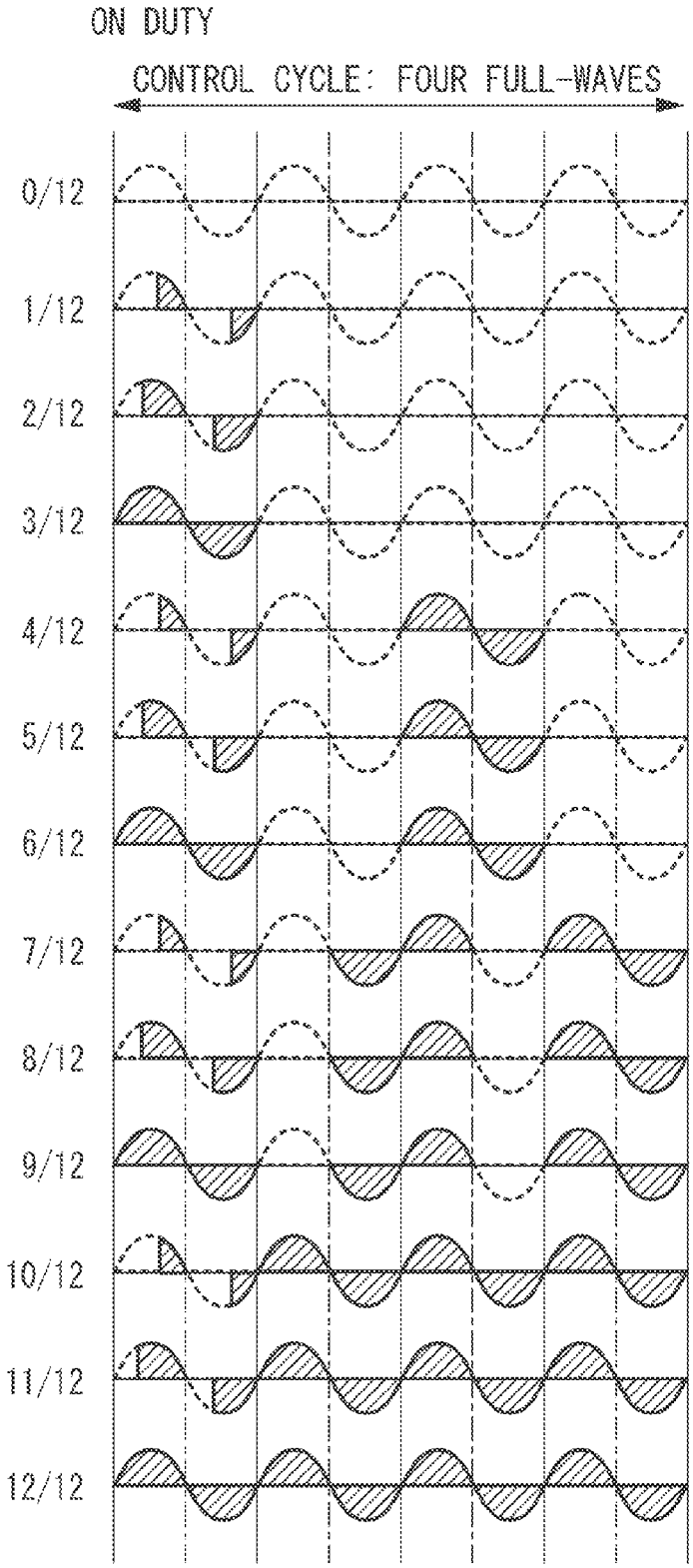
FIG. 12 illustrates a control table.

FIGS. 1A and 1B (the control tables according to the exemplary embodiment) and FIG. 12 illustrate examples of the heater power control patterns in the method of the combination of the phase control and the wave number control. FIG. 12 is a comparative example for describing the effects of the control patterns according to the exemplary embodiment. In the pattern, four full-cycles (=eight half-cycles) constitute one control cycle, in which six half-cycles are controlled in the wave number control, and two half-cycles are controlled in the phase control. FIGS. 1A and 1B illustrate the control patterns (the control tables) for heater power control according to the exemplary embodiment. In FIGS. 1A and 1B, four full-cycles (=eight half-cycles) constitute one control cycle. FIG. 1A illustrates a control table (first control table) to be selected when a control target temperature is lower than a threshold temperature, in which, in the eight half-cycles, six half-cycles are controlled in the wave number control, and two half-cycles are controlled in the phase control. FIG. 1B illustrates a control table (second control table) to be selected when a control target temperature is higher than the threshold temperature, in which, in the eight half-cycles, four half-cycles are controlled in the wave number control, and four half-cycles are controlled in the phase control. As illustrated in FIGS. 1A and 1B, in the exemplary embodiment, as the control tables, a plurality of control tables of different ratios of the phase control waveforms and the wave number control waveforms in one control cycle have been set.

In the individual tables, the power ratio (also referred to as power level, on duty, or power duty) obtained by dividing the electric power ranging from 0% to 100% into twelve have been set. FIGS. 1A and 1B illustrate AC waveforms (control patterns) to be supplied to the heater at individual power ratios. With reference to the example in FIG. 12, in a case where the power duty is at 1/12 (=8.3%), the phase control is performed such that the power duty of the first and second half-cycles is to be 33.3%. Further, the parts of the rest of the six half-cycles in the wave number control are set to off to supply the electric power of about 8.3% in one control cycle.

To perform the phase control such that the power duty of the half-cycles is to be 33.3%, the CPU 309 converts the power ratio to be supplied into a corresponding phase angle, and sends an ON signal to the transistor 308. For example, the CPU 309 includes data (conversion table of power ratio and phase angle) like table 1 below, and based on the control table, performs the control.

TABLE 1

| Power ratio Duty D (%) | Phase angle α (deg) |
|---|---|
| 100 | 0 |
| 97.5 | 28.56 |
| . | . |
| . | . |
| . | . |
| 75 | 66.17 |
| . | . |
| . | . |
| . | . |
| 50 | 90 |
| . | . |
| . | . |
| . | . |
| 25 | 113.83 |
| . | . |
| . | . |
| . | . |
| 2.5 | 151.44 |
| 0 | 180 |

If the power duty is at 7/12(=58.3%), both the first and second half-cycles are turned on such that the overall power duty of the half-cycles is to be 33.3%. In the parts of the rest of the six half-cycles in the wave number control, the fourth, fifth, seventh, and eighth half-cycles are turned on to supply the electric power of about 58.3% in the one control cycle. In such a way, to the power duty 12/12 at which the power supply is to be 100%, the control patterns of thirteen levels as illustrated in FIG. 12 are defined.

In the control patterns of 13 levels in FIGS. 1A and 1B, at the power duty 2/12, 5/12, and 8/12 to 10/12, the current waveforms according to the exemplary embodiment are employed, that is, the ratios of the phase control waveforms and the wave number control waveforms in the one control cycle are different in the first control table and the second control table.

With reference to the control pattern (control table to be selected when the target temperature is high) at high temperature in FIG. 1B, influence on harmonics in using the same control pattern in all target temperature regions will be described below.

The control pattern illustrated in FIG. 1B is configured with one control cycle including the phase control and the wave number control respectively having four half-cycles. As described above, to the harmonic suppression, the wave number control has an advantage. On the other hand, to the image quality increase of print images by suppressing uneven heat generation, the phase control has an advantage. Consequently, to increase the image quality, within a range the harmonic specifications are satisfied, the number of the half-cycles to be controlled by the phase control is set to a maximum number.

In general, resistors have temperature characteristics, and similar characteristics apply to the heat generating resistor formed on the ceramic heater. The characteristics are called temperature coefficient of resistance, and the coefficient indicates an amount of change in resistance values with temperature change in the resistance element. The resistance increases with increasing temperature, and the characteristics are called a positive temperature coefficient of resistance. On the other hand, the resistance decreases with increasing temperature, and the characteristics are called a negative temperature coefficient of resistance. In the first exemplary embodiment, the control tables suitable for the ceramic heater having the positive temperature coefficient are provided.

In the power control of the fixing unit 115, depending on the type of the paper, the usage environment, and the like, the target temperature for the control is to be changed to optimize the print conditions. As described above, due to the influence of the positive temperature coefficient, the resistance value of the resistance element of the ceramic heater during the control varies depending on the target temperature. Consequently, if the control pattern optimized based on the state the target temperature is high (the heater resistance value is high) as a reference is used, when the target temperature is lowered, the heater resistance value decreases to exert influence. Specifically, with decreasing resistance values, the electric current flowing through the heater increases, and this result in deterioration in the harmonic level. On the other hand, if the state the target temperature is low (the heater resistance value is low) is used as a reference, the number of times of the phase control in one control cycle in a state the target temperature is set to a high temperature becomes smaller than the number of times of the phase control that can be performed. As a result, the heat generation becomes quite uneven to cause deterioration in the image quality of the printed image.

To solve the problems, in the first exemplary embodiment, as illustrated in FIGS. 1A and 1B, the two control patterns (control tables) have been set with a boundary of the target temperature of 150° C. (=the threshold temperature). At the high temperature side, the heater resistance value is high, and this is advantageous to the harmonic level. Consequently, to increase the image quality of print images, the number of times of execution of the phase control in one control cycle is set to a value as many as possible. On the other hand, at the low temperature side, the heater resistance value is low, and this is disadvantageous to the harmonic level. Consequently, to suppress the harmonic level to prevent the apparatus from exceeding the harmonic specifications, the number of times of execution of the phase control in one control cycle is set to the number of times smaller than that at the high temperature side.

Figure 6:
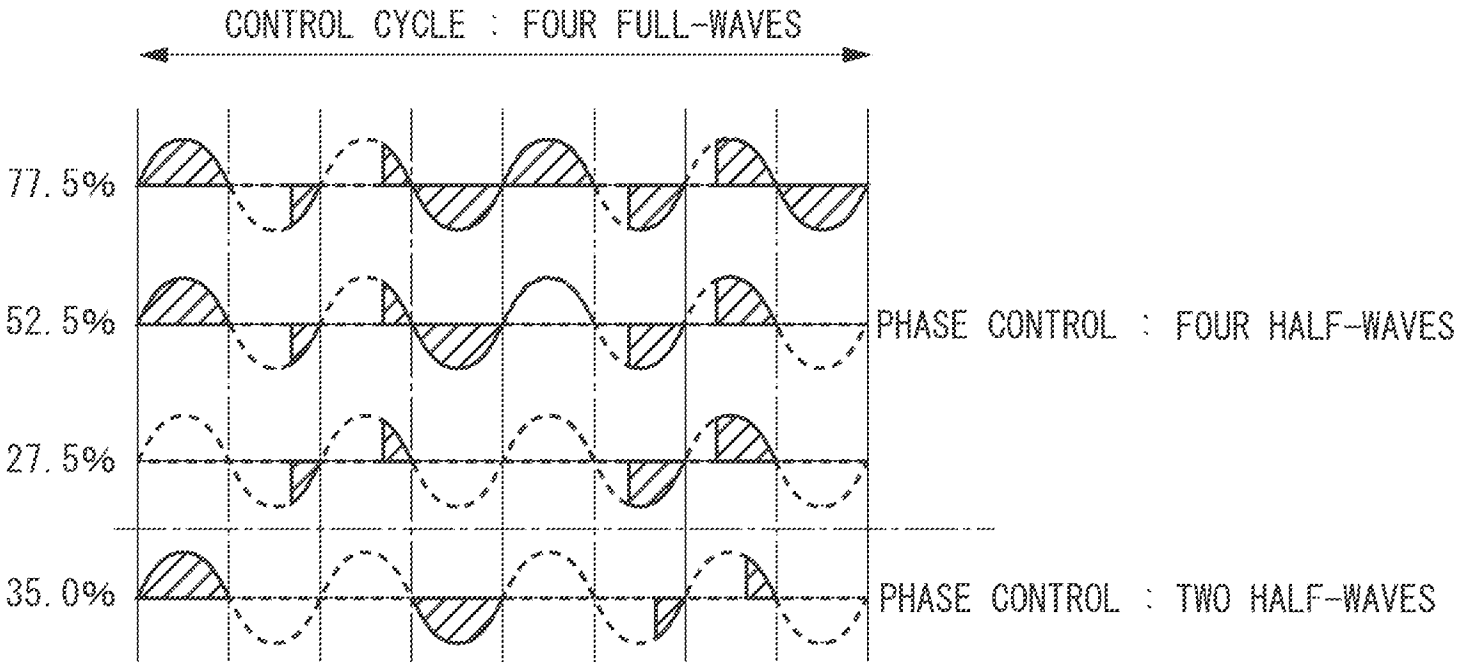
FIG. 6 illustrates waveforms used in a harmonic level measurement.
Figure 7:
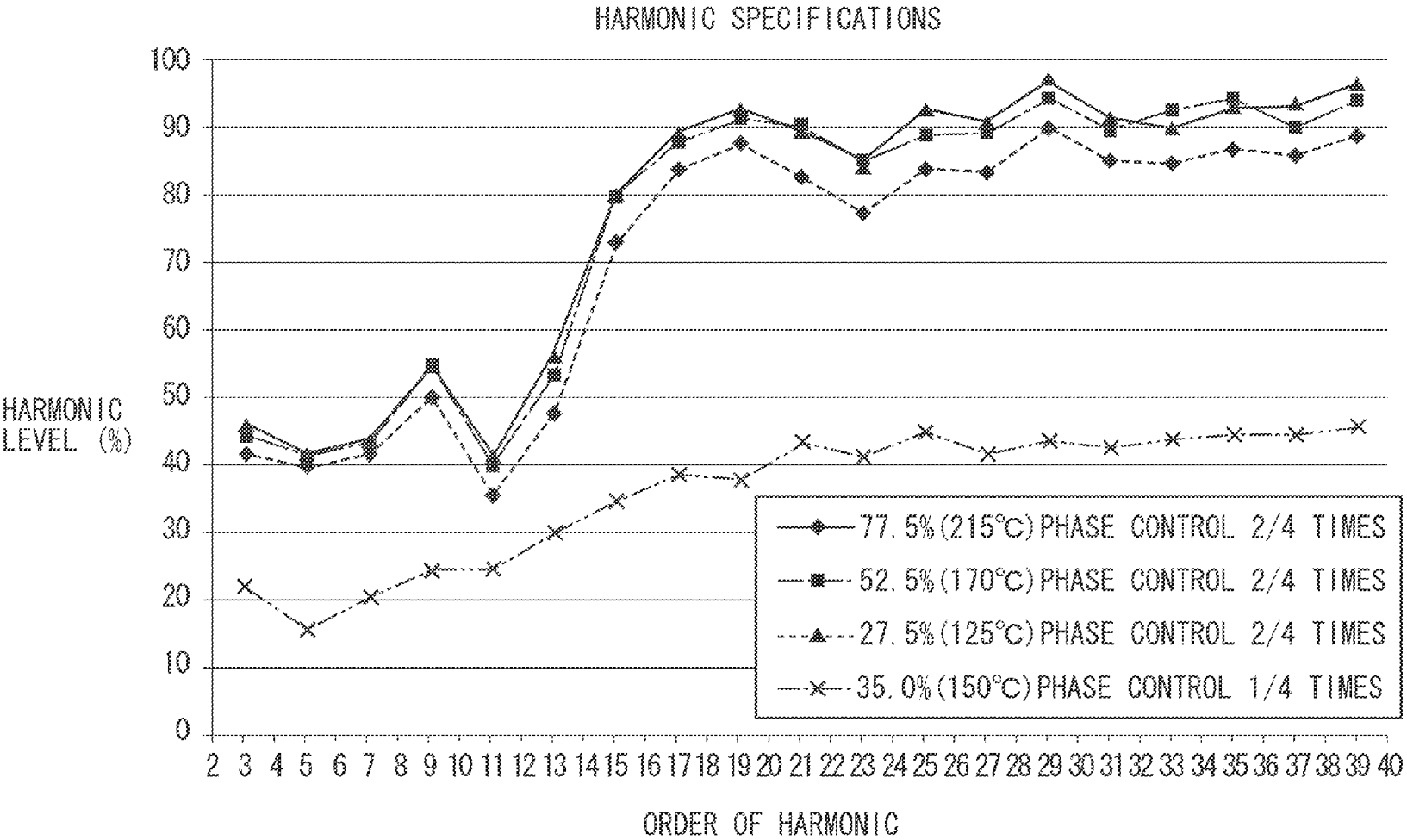
FIG. 7 illustrates the result of the harmonic level measurement.

The influence on the harmonic levels will be described in detail. FIG. 6 illustrates a control pattern, in which the number of times of the phase control in one control cycle is four half-cycles having the power supply of 77.5%, 52.5%, and 27.5%, and a control pattern, in which the number of times of the phase control performed in one control cycle is two half-cycles having the power supply of 35.0%. FIG. 7 is a graph illustrating the harmonic level observed when the measurement is performed under the above conditions. The comparison of the graphs observed when the number of times of the phase control is four half-cycles shows that the decrease in the target temperature results in deterioration in the harmonic level. Specifically, the decrease in the temperature from 215° C. to 125° C. worsens the harmonic level by about nine points, and in consideration of variations in initial resistance values, the harmonic level may worsen by 10 points or more. On the other hand, the graph observed when the number of times of the phase control is two half-cycles shows that even if the target temperature is low, enough margins are provided with respect to the specifications of the harmonic level.

As described above, the two control tables for the power control are provided, and the tables to be used for the control are switched at a predetermined value of the target temperature, for example, at the threshold of 150° C. The mechanism can suppress the influence of the temperature coefficient, and while the image quality of printed images obtained when the target temperature is high is ensured, the deterioration in the harmonic level that occurs when the target temperature is low can be reduced. The number of the control tables and the threshold temperatures is not limited to the above-described number, the number greater than the above-described number may be employed.

Figure 8:
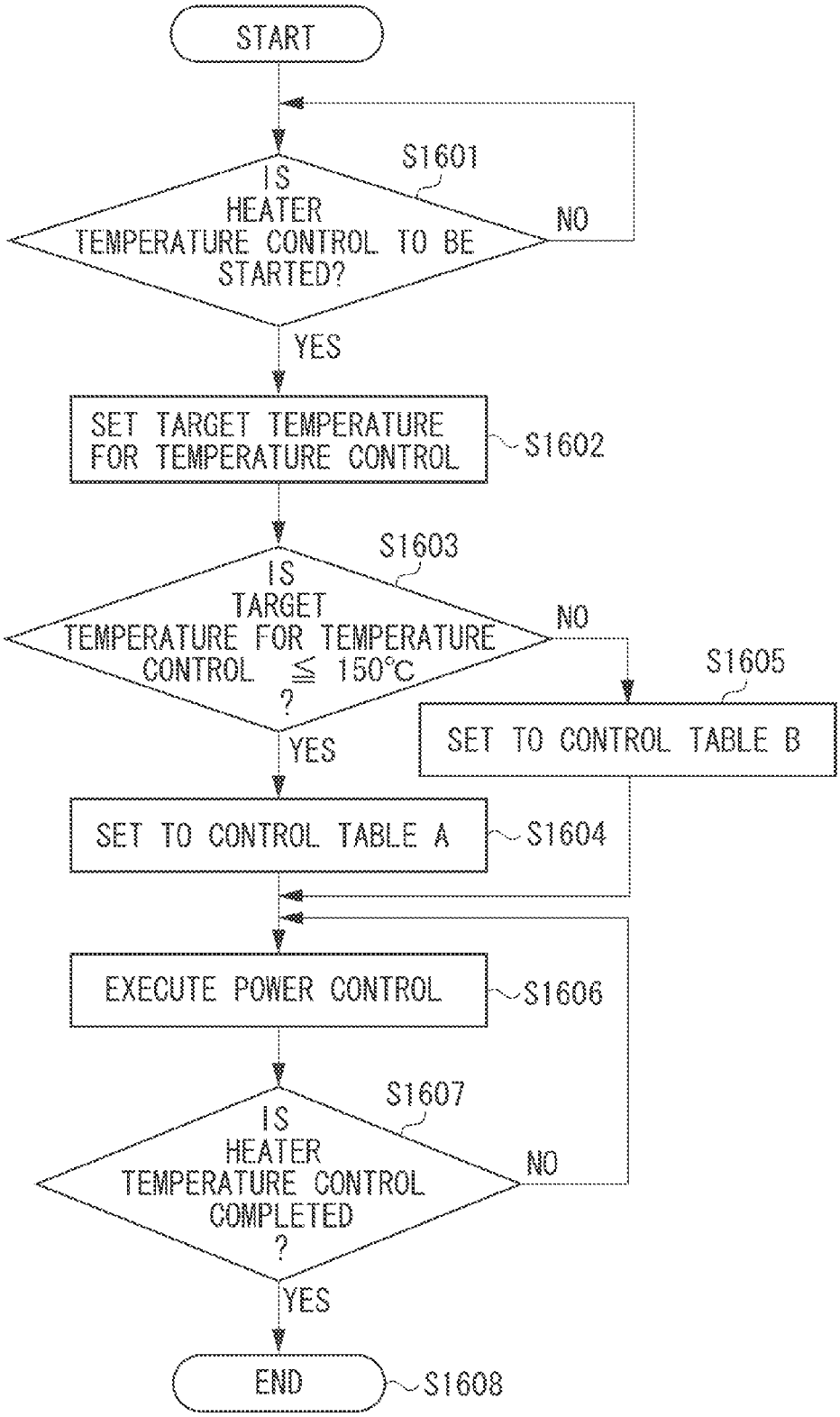
FIG. 8 is a control flowchart according to the first exemplary embodiment.

The control sequence of the fixing unit 115 according to the first exemplary embodiment is described. FIG. 8 is a flowchart illustrating the control sequence of the fixing unit 115 performed by the CPU 309 according to the first exemplary embodiment.

In step S1601, the CPU 309 determines whether a request for starting power supply to the ceramic heater 202 is issued. If the request is issued (YES in step S1601), the process proceeds to step S1602.

In step S1602, to handle differences such as the type of sheet, the print speed, and the like, the CPU 309 sets an optimal target temperature to each print mode.

In step S1603, the CPU 309 determines whether the target temperature set in step S1602 is higher or equal to or lower than the set target temperature threshold of 150° C. If the target temperature is equal to or lower than the threshold (YES in step S1603), the process proceeds to step S1604. If the target temperature is higher than the threshold (NO in step S1603), the process proceeds to step S1605.

In step S1604, the CPU 309 selects the control table (the first control table A) optimized for the power control to be performed if the set target temperature is equal to or lower than the threshold temperature, and thereby the control table is set as the source of reference to the power control being performed. In step S1605, the CPU 309 selects the control table (the second control table B) optimized for the power control to be performed if the set target temperature is higher than the threshold temperature, and thereby a setting similar to that in step S1604 is performed.

In step S1606, based on the control table set in step S1604 or S1605, the CPU 309 executes the power control.

In step S1607, the CPU 309 repeats the power control in step S1606 until the printing operation is completed. If the printing operation is completed (YES in step S1607), the process proceeds to step S1608, and the control ends.

As described above, the apparatus according to the exemplary embodiment includes the heater having the positive temperature coefficient, and the first control table and the second control table in which the ratio of the phase control waveforms is higher than that in the first control table have been set to the apparatus as the control tables. The power control unit selects the first control table if the set target temperature is equal to or lower than the threshold temperature, and selects the second control table if the set target temperature is higher than the threshold temperature.

The second exemplary embodiment is described.

In the second exemplary embodiment, similar to the first exemplary embodiment, a power control method suitable for the temperature coefficient of resistance of the ceramic heater 202 is proposed. The second exemplary embodiment provides a mechanism similar to that in the first exemplary embodiment other than the characteristics of the temperature coefficient of resistance of the heater. In the second exemplary embodiment, as the ceramic heater 202, a ceramic heater having a negative temperature coefficient is employed. The ceramic heater has characteristics that the resistance decreases with increasing temperature of the resistance element.

In the power control of the fixing unit 115, depending on the type of the sheet, the usage environment, and the like, the target temperature for the control is to be changed to optimize the print conditions. As described above, due to the characteristics of the negative temperature coefficient, the resistance value of the resistance element of the ceramic heater 202 in control varies depending on the target temperature. Consequently, using a control pattern optimized based on a state the target temperature is high (the heater resistance value is low), if the target temperature is set to a low temperature, the heater resistance value increases to exert influence.

Specifically, the increase in the resistance value reduces the current flowing through the heater, and as a result, the harmonic level can be improved. On the other hand, the number of times of the phase control in one control cycle becomes smaller than the number of times of the phase control that can essentially be performed. As a result, the heat generation becomes quite uneven, to cause deterioration in the image quality of the printed image. On the other hand, if a state the target temperature is low (the heater resistance value is high) is used as a reference, if the target temperature is set to a high temperature, the resistance value decreases, so that the current flowing through the heater increases. Thereby, the harmonic level can be deteriorated.

Figure 9A:
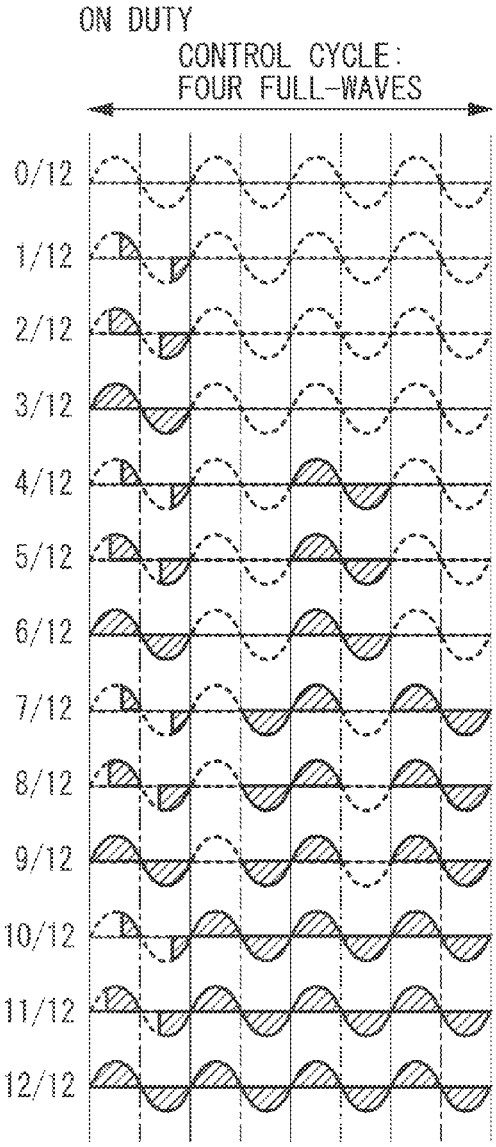
FIGS. 9A and 9B illustrate control tables to be used when a NTC heater is used.
Figure 9B:
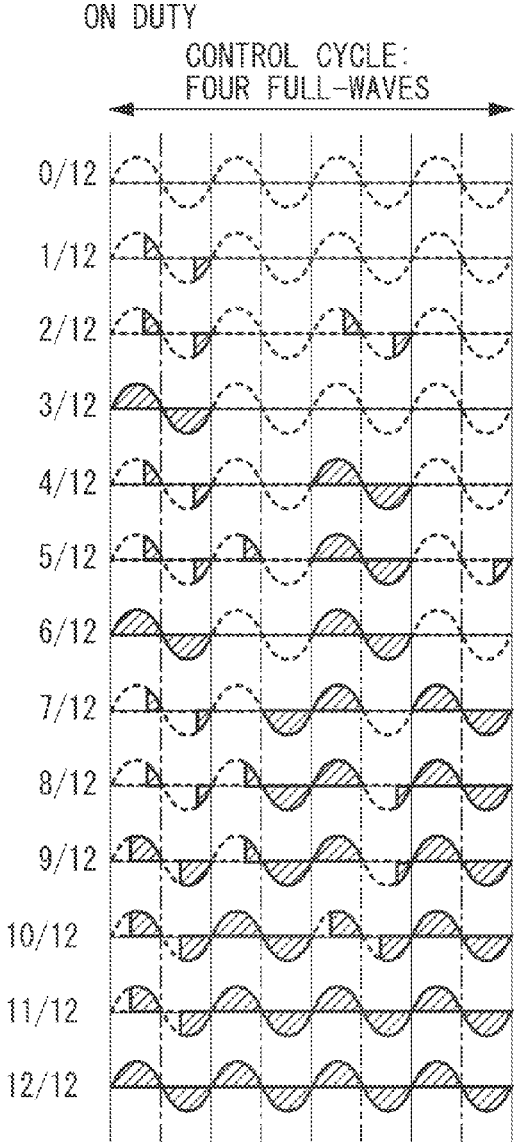

To solve the problems, in the second exemplary embodiment, as illustrated in FIGS. 9A and 9B, two control patterns (control tables) have been set with a boundary of the target temperature of 150° C. (=the threshold temperature). At the low temperature side (in a case where the target temperature is set to a temperature equal to or lower than the threshold temperature), the heater resistance value is high, and this is advantageous to the harmonic level. Consequently, to increase the image quality of print images, the number of times of execution of the phase control in one control cycle is set such that the number of times of execution can be increased as much as possible (the control table (second control table) in FIG. 9B is selected).

On the other hand, at the high temperature side (in a case where the target temperature is set to a temperature higher than the threshold temperature), the heater resistance value is low, and this is disadvantageous to the harmonic level. Consequently, to suppress the harmonic level to prevent the apparatus from exceeding the harmonic specifications, the number of times of execution of the phase control in one control cycle is set to the number of times smaller than that at the low temperature side (the control table (first control table) in FIG. 9A is selected).

With respect to the influence on the harmonic level, as described in the first exemplary embodiment, the harmonic level varies depending on the target temperatures. In the heater having the negative temperature coefficient, the harmonic level worsens with increasing target temperature. Meanwhile, similarly to the heater having the positive temperature coefficient, reduction in the number of times of execution of the phase control in one control cycle can improve the harmonic level.

As described above, the two control tables for the power control are provided, and the tables used for the control are switched at a predetermined value of the target temperature, for example, at the threshold of 150° C. The mechanism can suppress the influence of the temperature coefficient, and while the deterioration in the harmonic level that occurs when the target temperature is high can be suppressed, the image quality of printed images obtained when the target temperature is low can be ensured. The number of the control tables and the threshold temperatures is not limited to the above-described number, the number greater than the above-described number may be employed.

Figure 10:
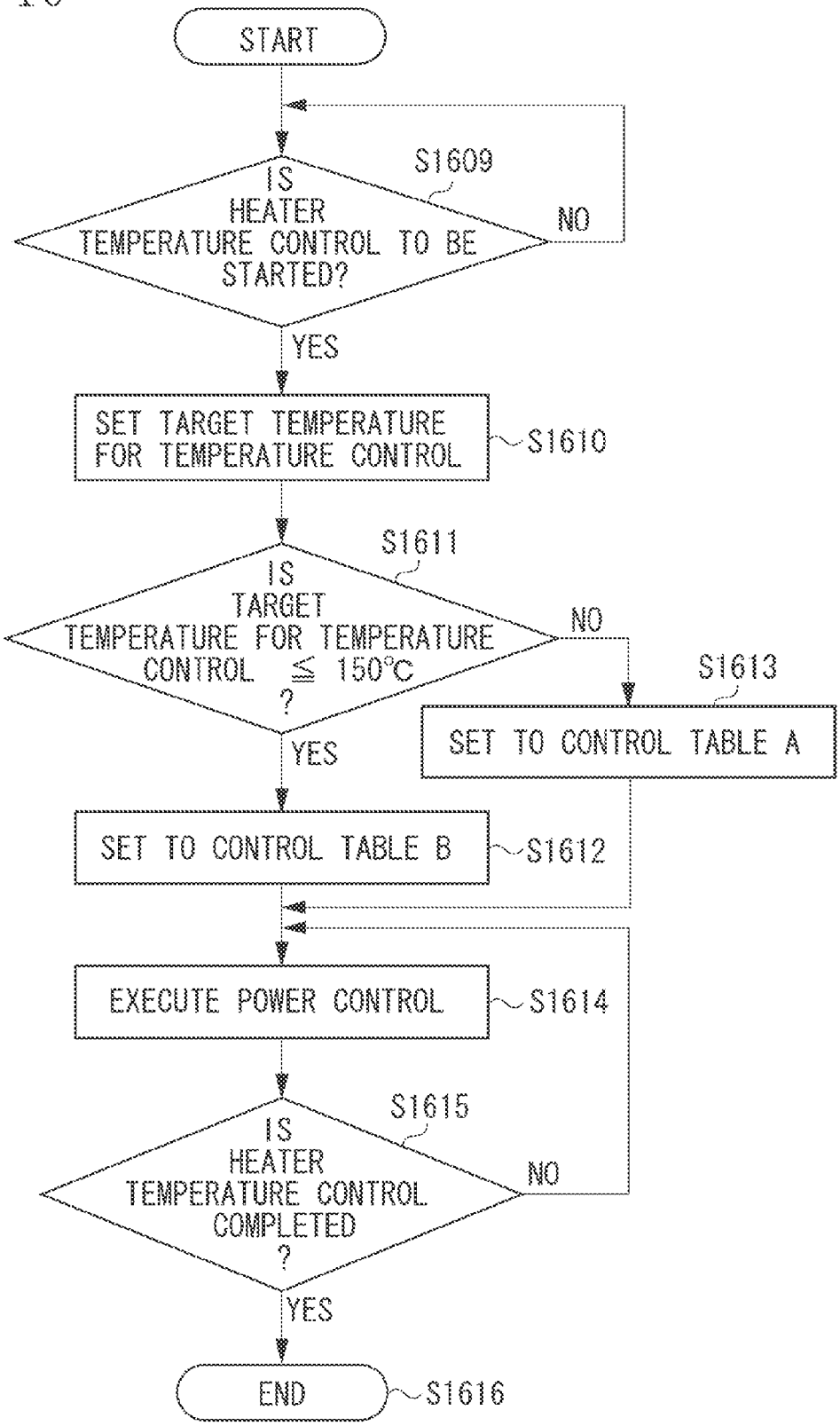
FIG. 10 is a control flowchart according to the second exemplary embodiment.

The control sequence of the fixing unit 115 according to the second exemplary embodiment is described. FIG. 10 is a flowchart illustrating the control sequence of the fixing unit 115 performed by the CPU 309 according to the second exemplary embodiment.

In step S1609, the CPU 309 determines whether a request for starting power supply to the ceramic heater 202 is issued. If the request is issued (YES in step S1609), the process proceeds to step S1610.

In step S1610, to handle differences such as the type of sheet, the print speed, and the like, the CPU 309 sets an optimal target temperature to each print mode.

In step S1611, the CPU 309 determines whether the target temperature set in step S1611 is higher or equal to or lower than the set threshold of 150° C. If the target temperature is equal to or lower than the threshold (YES in step S1611), the process proceeds to step S1612. If the target temperature is higher than the threshold (NO in step S1611), the process proceeds to step S1613.

In step S1612, the CPU 309 selects the control table (the second control table B) optimized for the power control to be performed if the set target temperature is equal to or lower than the threshold temperature, and thereby the control table is set as the reference source to the power control being performed. In step S1613, the CPU 309 selects the control table (the first control table A) optimized for the power control to be performed if the set target temperature is higher than the threshold temperature, and thereby a setting similar to that in step S1612 is performed.

In step S1614, based on the control table set in step S1612 or S1613, the CPU 309 executes the power control.

In step S1615, the CPU 309 repeats the power control in step S1614 until the printing operation is completed. If the printing operation is completed, the process proceeds to step S1616, and the control ends.

As described above, the apparatus according to the exemplary embodiment includes the heater having the negative temperature coefficient, and the first control table and the second control table in which the ratio of the phase control waveforms is higher than that in the first control table have been set to the apparatus as the control tables. The power control unit selects the second control table if the set target temperature is equal to or lower than the threshold temperature, and selects the first control table if the set target temperature is higher than the threshold temperature.

According to the exemplary embodiments, the image forming apparatus capable of maintaining the image quality while suppressing the deterioration in the harmonic level due to the influence of the temperature coefficients of resistance can be provided.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2012-094055, filed Apr. 17, 2012 which is hereby incorporated by reference herein in its entirety.

What is claimed is:

1. An image forming apparatus comprising:

a fixing unit configured to perform heat fixing an unfixed toner image formed on a recording sheet onto the recording sheet, the fixing unit includes a heater that generates heat by electric power supplied from an alternating-current power supply; and a power control unit configured to control the electric power to be supplied to the heater such that the fixing unit is kept to a target temperature, wherein the power control unit is configured to select a power level per one control cycle from a control table in which a plurality of power levels have been set in accordance with a temperature of the fixing unit, the duration of the one control cycle being defined by a predetermined number of consecutive half-cycles in an alternating-current waveform, wherein the alternating-current waveform flowing in the heater in the one control cycle including a phase control waveform in which a current flows only in a part of a half-cycle of the alternating-current waveform and a wave number control waveform in which all current flows in a half-cycle of the alternating-current waveform, wherein as the control table, a plurality of control tables having different ratios of the phase control waveforms and the wave number control waveforms in the one control cycle have been set, and the control unit is configured to select one of the plurality of control tables depending on a set target temperature, and select a power level from the selected control table in accordance with the temperature of the fixing unit.

2. The image forming apparatus according to claim 1, wherein the heater has a positive temperature characteristics of resistance, as the control table, a first control table and a second control table in which the ratio of the phase control waveforms is larger than the ratio of the phase control waveforms in the first control table have been set, and the power control unit is configured to select the first control table if the set target temperature is lower than a threshold temperature, and select the second control table if the set target temperature is higher than the threshold temperature.

3. The image forming apparatus according to claim 1, wherein the heater has a negative temperature characteristics of resistance, wherein as the control table, a first control table and a second control table in which the ratio of the phase control waveforms is larger than the ratio of the phase control waveforms in the first control table have been set, and wherein the power control unit is configured to select the second control table if the set target temperature is lower than a threshold temperature, and to select the first control table if the set target temperature is higher than the threshold temperature.

4. The image forming apparatus according to claim 1, wherein the fixing unit includes an endless belt.

5. The image forming apparatus according to claim 4, wherein the heater is in contact with the inner surface of the endless belt.

6. The image forming apparatus according to claim 5, wherein the fixing unit includes a roller for forming a fixing nip portion together with the heater via the endless belt for pinching and conveying the recording sheet.

7. A method of controlling electric power to be supplied to a heater in a fixing unit, the method comprising:

selecting a control table depending on a target temperature of the fixing unit from a plurality of control tables having different ratios of phase control waveforms in which a current flows only in a part of a half-cycle of the alternating-current waveform and wave number control waveforms in which all current flows in a half-cycle of the alternating-current waveform in one control cycle;

selecting a power level corresponding to a temperature of the fixing unit from the selected control table; and supplying electric power to the heater at the selected power level.

8. The method according to claim 7, wherein the heater has a positive temperature characteristics of resistance, wherein a first control table and a second control table in which the ratio of the phase control waveforms is larger than the ratio of the phase control waveforms in the first control table have been set as the control table, and wherein the first control table is selected if the set target temperature is lower than a threshold temperature, and the second control table is selected if the set target temperature is higher than the threshold temperature.

9. The method according to claim 7, wherein the heater has a negative temperature characteristics of resistance, wherein a first control table and a second table in which the ratio of the phase control waveforms is larger than the ratio of the phase control waveforms in the first control table have been set as the control table, and wherein the second control table is selected if the set target temperature is lower than a threshold temperature, and the first control table is selected if the set target temperature is higher than the threshold temperature.

10. An image forming apparatus comprising:

a fixing unit configured to perform heat fixing an unfixed toner image formed on a recording sheet onto the recording sheet, the fixing unit includes a heater that generates heat by electric power supplied from an alternating-current power supply and has a positive temperature characteristics of resistance;

a power control unit configured to control the electric power to be supplied to the heater such that the fixing unit is kept to a target temperature, the power control unit selects a power level per one control cycle in accordance with a temperature of the fixing unit, the duration of the one control cycle being defined by a predetermined number of consecutive half-cycles in an alternating-current waveform, and the alternating-current waveform flowing in the heater in the one control cycle including a phase control waveform and a wave number control waveform;

a first control table; and a second control table in which the ratio of the phase control waveforms is larger than the ratio of the phase control waveforms in the first control table have been set, wherein the power control unit selects the power level from the first control table if the set target temperature is lower than a threshold temperature, and selects the power level from the second control table if the set target temperature is higher than the threshold temperature.

11. The image forming apparatus according to claim 10, wherein the fixing unit includes an endless belt.

12. The image forming apparatus according to claim 11, wherein the heater is in contact with the inner surface of the endless belt.

13. The image forming apparatus according to claim 12, wherein the fixing unit includes a roller for forming a fixing nip portion together with the heater via the endless belt for pinching and conveying the recording sheet.

14. An image forming apparatus comprising:

a fixing unit configured to perform heat fixing an unfixed toner image formed on a recording sheet onto the recording sheet, the fixing unit includes a heater that generates heat by electric power supplied from an alternating-current power supply and has a negative temperature characteristics of resistance;

a power control unit configured to control the electric power to be supplied to the heater such that the fixing unit is kept to a target temperature, the power control unit selects a power level per one control cycle in accordance with a temperature of the fixing unit, the duration of the one control cycle being defined by a predetermined number of consecutive half-cycles in an alternating-current waveform, and the alternating-current waveform flowing in the heater in the one control cycle including a phase control waveform and a wave number control waveform;

a first control table; and a second control table in which the ratio of the phase control waveforms is larger than the ratio of the phase control waveforms in the first control table have been set, wherein the power control unit selects the power level from the second control table if the set target temperature is lower than a threshold temperature, and selects the power level from the first control table if the set target temperature is higher than the threshold temperature.

15. The image forming apparatus according to claim 14, wherein the fixing unit includes an endless belt.

16. The image forming apparatus according to claim 15, wherein the heater is in contact with the inner surface of the endless belt.

17. The image forming apparatus according to claim 16, wherein the fixing unit includes a roller for forming a fixing nip portion together with the heater via the endless belt for pinching and conveying the recording sheet.

* * * * *